United States Patent [19]

Böse

[11] 4,098,254

[45] Jul. 4, 1978

[54] HEATING DEVICE

[76] Inventor: Theo William Böse, 28 Reitmorstrasse, 8 Munich 22, Fed. Rep. of Germany

[21] Appl. No.: 620,031

[22] Filed: Oct. 6, 1975

[30] Foreign Application Priority Data

Oct. 7, 1974 [DE] Fed. Rep. of Germany ..... 2447794
Oct. 7, 1974 [DE] Fed. Rep. of Germany ..... 2447793
Oct. 7, 1974 [DE] Fed. Rep. of Germany ..... 2447734

[51] Int. Cl.[2] ..... A01G 13/06; F23L 0/00; F24B 5/00

[52] U.S. Cl. ..... 126/79; 126/59.5; 431/115

[58] Field of Search ..... 431/115, 116; 126/59.5, 126/79

[56] References Cited

U.S. PATENT DOCUMENTS

| | | | |
|---|---|---|---|
| 944,745 | 12/1909 | Plank et al. | 126/59.5 |
| 2,284,157 | 5/1942 | Leonard | 431/115 |
| 2,641,085 | 6/1953 | Robinson et al. | 126/59.5 |
| 3,698,379 | 10/1972 | Cheney | 126/59.5 |

FOREIGN PATENT DOCUMENTS

| | | | |
|---|---|---|---|
| 1,249,505 | 1960 | France | 126/59.5 |
| 92,185 | 1959 | Netherlands | 126/59.5 |

*Primary Examiner*—Paul E. Maslousky

[57] ABSTRACT

A heating plant has a fuel container with an evaporation space or chamber from which evaporated fuel is passed to a combustion chamber. Combustion gases pass from the combustion chamber through a heating tube, for discharge, while part of said gases is fed back to the evaporation chamber. The feedback path has variable insulation or flow control to control the feedback gas temperature thus to maintain constant the amount of heat fed back, irrespective of the combustion chamber heat output. The connections of evaporation chamber to combustion chamber and evaporation chamber to heating tube, by way of the gas feedback tube, are rendered more secure by mechanical support means such as bracing struts, to resist operating and transportation stresses.

24 Claims, 15 Drawing Figures

HEATING DEVICE

BACKGROUND OF THE INVENTION

This invention relates to a heating device, of the kind having a fuel container in which a liquid fuel, for example oil, is evaporated within an evaporation chamber, having a combustion chamber which is mounted on the fuel container and in which the evaporated fuel is burnt, having a heating tube which is connected to the combustion chamber, and having a gas feed-back or return device which air-tightly connects the heating tube to the evaporation chamber in the fuel container and returns into the evaporation chamber a portion of the combustion gases which pass into the heating tube.

In a known heating device of this kind of construction, which is operated for example as a so-called air-oil heater, the heating gases are produced by means of an operating flame on the fuel oil which is in the fuel container. However, this results in a sooty flame, which has disadvantageous consequences. Therefore the present invention is basically concerned with a heating device of this kind, but which operates without any such flame on the surface of the oil which is disposed in the fuel container, the fuel container thus serving as the evaporation tank. This however is only possible if particular care is taken to ensure that certain parts of the heating device, for example the cover of the fuel container, the fuel container itself and also the combustion chamber, are heat-insulated.

It has also been found that operating a heating device without the above-mentioned flame on the surface of the fuel oil in the fuel container is only possible when the above-mentioned gas feedback device is in the form of a tube bend and a gas feedback tube, of a special contruction. The tube bend advantageously comprises a cast material. In this kind of arrangement, the fuel oil which is vaporised in the evaporation tank is heated by the heating gases which are fed back from the heating tube by way of the gas feedback device, so as to provide constant operation of the heating device without the above-mentioned operating fire on the fuel oil surface. With this gas feedback device, the straight gas feedback tube is fixedly connected at its lower end to the upper cover of the fuel container, for example by means of a flange connection, while the upper end of the gas feedback tube is connected to the tube bend by way of a plug-in connection. In this arrangement, in which the tube bend is for example a 180° bend, one half of the tube bend is arranged within the heating tube, while the open end of said half, being disposed centrally within the heating tube, faces downwardly in the direction of the combustion chamber. The other half of the tube bend is arranged outside the heating tube and is there connected to the gas feedback tube. Now, in such a heating device, the oil combustion gases which rise out of the heat-insulated evaporation tank are burnt in the combustion chamber, which has perforations, and are then in part returned to the evaporation tank, due to the reduced pressure which prevails in the evaporation tank, passing by way of the portion of the tube bend which is within the heating tube, the outer portion of the tube bend, and the gas feedback tube. This arrangement can possibly result in secondary combustion. It is therefore particularly important for such a heating device that the heating gases which are fed back to the evaporation tank are returned thereto at a high temperature, without substantial cooling of the gases occurring over the feed-back path. Such cooling can occur particularly when the heating device is installed in the open air, as so-called point heaters.

SUMMARY OF THE INVENTION

It is a problem of the present invention to improve a heating device of the kind set out above.

A further object of the invention is to construct such a heating device in such a way that it is possible to regulate to a constant level the amount of heat which is returned to the evaporation chamber by the feedback of heating gases, during heating operations, and that it is always possible to provide for absolute separation of the flame from the surface of the oil in the fuel container, irrespective of the location of the heating device, for example in the open air or in a closed room.

A further object is to ensure that combustion of the fuel or oil gases is soot-free.

A further object is to exclude faulty operation of the igniter for triggering the heating operation of the heating device, and to ensure that the operator is not endangered by the exhaust discharge of unburnt residual gases.

Yet another object of the invention is to ensure that the heating device is of a robust construction, thereby ensuring that all the components of the device are firmly secured together, and in particular that there is always an air-tight connection between the heating tube and the evaporation chamber, by way of the gas feedback line, even after the device has been transported, so that the device is ready for installation and operation immediately after it has been transported to its point of installation.

Accordingly, the present invention provides, in a heating device comprising: a fuel container in which a liquid fuel such as oil can be evaporated within an evaporation chamber; a combustion chamber connected on the fuel container, for combustion of the evaporated fuel; a tube connected to the combustion chamber, for carrying combustion gases therefrom; and a gas feedback means air-tightly connecting the heating tube to the evaporation chamber, for returning to the evaporation chamber a part of the combustion gases in the heating tube, thereby to cause evaporation of fuel during operation; the improvement wherein the gas feedback means is controllable to regulate the amount of heat introduced into the evaporation chamber by the fedback gas, thereby to maintain said amount at a substantially constant level, and wherein mechanical support means is provided on the heating device, for sustaining the respective air-tight connections between the evaporating chamber and the combustion chamber and between the heating tube and the evaporation chamber, both during heating operation and also during transportation of the heating device.

The present invention is therefore based on the concept of disposing a heat protection or insulation sleeve around the part of the above-mentioned tube bend disposed outside the heating tube, and also the gas feedback tube. The heat protective sleeve is open towards the heating tube and permits the amount of heat carried by the heating gases to be regulated to a constant level. The heat protective sleeve provides an additional heating effect for the tube bend and for the gas feedback tube, due to the heat which is radiated back by the protective sleeve.

With this invention, it is now possible for the heat protective sleeve to be arranged horizontally displaceably on the heating device, or for the sleeve to be constructed in a two-part structure, one part of the sleeve enclosing the gas feedback tube and the other part of the sleeve being formed as a heat protective cap for covering the tube bend, the cap being pivotal between a raised and a lowered position. This arrangement makes it possible to control the heat output of the heating gases, and thus the amount of heat fed back to the evaporation chamber. Such regulation is desirable as the through-put of air through the perforations or gills of the combustion chamber is such as to ensure optimum heat output. With a falling level of fuel in the evaporation chamber, the heating output usually falls away considerably, as the distance from the heating flame in the combustion chamber and from the point of entry of the heating gases which are fed back by means of the gas feedback tube increases as the fuel level drops. This necessarily means that, with a combustion chamber which is desired for the maximum air through-put and with the fuel container of the heating device filled up, an excessive amount of heating gases is produced in the initial operating period, for example in the first three to five hours of operation in which the fuel level is high in the fuel container. This would not ensure for stoichiometrically optimum combustion of the heating gases.

However, by means of the invention, it is possible to achieve a controlled reduction in heat, by means of suitable displacement of the heat protective sleeve away from the gas feedback device or by suitable raising of the heat protective cap over the tube bend, in the above-mentioned initial period of operation. This results in an intentional drop in heat output, and this cuts out the danger of sooting and at the same time stabilises the heat output curve as the fuel level falls if, as provided in accordance with the invention, the complete heat insulation for the tube bend and the gas feedback tube, is restored, either manually or automatically, by suitable movement of the heat protective sleeve, after the above-mentioned initial period of operation has passed.

Instead of moving the heat protective sleeve horizontally away from the gas feedback device or lifting the heat protective cap as mentioned above, it is also possible for the heat protective sleeve to be left in its position on the gas feedback device and instead to provide a control or regulating flap inside the gas feedback tube.

If manually operated, the regulating flap can be actuated by means of an outwardly extended handle, the handle and thus the flap being adjusted, in conjunction with a scale, in such a way that the flap correspondingly reduces the amount of heating gases which are fed back to the evaporation chamber. This makes it possible for the production of fuel oil gases in the evaporation chamber to be throttled in the desired manner so as to provide optimum combustion of the flame. After the above-mentioned initial period of operation has expired, for example after about five hours of operation, the regulating flap is adjusted in such a way, for example it is set vertically, that the internal cross-section of the feedback tube is completely free. This also eliminates the danger of over-stoichiometric combustion of the gases when the fuel is at a low level, and ensures optimum combustion with a uniform heat output.

This regulation of the heat output of the heating gases can also be carried out automatically, insofar as, for example, a bimetal spring connected to the regulating flap is used for controlling the flap. The bimetal spring can be arranged in the space within the heat protective sleeve, between the gas feedback tube and the heating tube, and can be in the form of a bimetal spiral spring.

In the heating device according to the invention, the device can be shut down in a completely reliable manner by means of a shut-off plate which can completely seal off the cross-sections of the heating tube and the gas feedback tube or the respective openings thereof, so that in its closed position the slide plate prevents a smokey exhaust discharge or the discharge of unburnt gases, when the device is shut down.

If however when shutting down the device, that is to say, when the shut-off slide plate is in its closed position of closing off the fuel container from the heating tube, the igniter is by mistake re-actuated without the slide plate being moved into its open position, there is the danger of intense smoke discharge and even explosion, solely through the relatively narrow ignition aperture of the igniter. This discharge is to be feared not just because ignition of the heating oil "EL" which is normally used generally occurs with the assistance of spirit, but also because the evaporation chamber may still contain heating gases which can easily ignite, some time after the device has been shut down. Such a discharge from the device when re-actuating the igniter will however give rise to extreme danger to an operator who is not sufficiently careful in operating the heating device.

With the present invention, account is taken of this problem and the invention thus provides a safety device for the igniter, for ensuring that there is no possibility of erroneous operation of the igniter, thereby to avoid the above-mentioned exhaust discharge dangers.

The slide plate is so constructed that in its closed position it blocks operation of the igniter, which is at the top of the fuel container, in the form of an ignition pipe with ignition slide which opens into the fuel container, while in its open position the slide plate releases the igniter for operation.

In the safety position the igniter is covered by a pivotal closure cap over which engages a locking bracket. The free end of the bracket engages into an opening or eye in a latch bar, when the rotatable slide plate is in its closed position and closes the cross-sectional flow areas of the heating tube and the gas feedback tube, or the respective apertures thereof.

Thus no ignition can occur before the slide plate has been brought into its open position; this is effected by drawing the locking bracket out of the said opening in the latch bar, and pivoting it out beyond the closure cap, while at the same time as the closure cap is liberated as just described, a pivotal lever assembly which is movable about pivot points is also actuated. This lever assembly is fixedly connected both to the locking bracket and also to the shaft of the rotatable shut-off slide plate. Therefore, when the locking bracket is pivotally actuated by actuation of the lever assembly, the shut-off slide plate is also moved into its open position in which it abuts against an edge or a side wall of a plate housing which mounts the shut-off slide plate. In this position the heating tube and the gas feedback tube are fully open for the through-flow of gas, and the locking bracket has also completely released the closure cap over the igniter. Thus, only when the heating tube is fully open can the closure cap be raised from the igniter. After the igniter tube has been opened by means of the ignition slide member, spirit ignition of the surface of the fuel oil in the evaporation chamber can then be effected without the danger of any exhaust discharge or explosion which may occur, acting through the narrow opening of the ignition pipe, as in that case any such discharge or explosion will pass through the heating tube and accordingly issue above the head of the operator, that is to say, at the free end of the heating tube.

Disposed above the free end of the heating tube, at a spacing therefrom, is an air distributer cover which is normally in a substantially horizontal position and which therefore forms an additional undesirable resistance to any exhaust discharge or explosion as mentioned above, which may possibly occur. This resistance however can be partly or even completely removed by means of the safety device according to the present invention, in that the closure cap of the igniter may be pivotally connected to the lower end of a vertical connection rod means which includes a rocking lever and which has its other connected to the air distributor cover. When therefore the closure cap of the igniter is raised, that is to say, when the shut-off side plate is in the open position, the air distributor cover is also raised by means of the connecting rod, that is to say, the air distributor cover is lifted from its support ring. Any discharge from the heating tube can thus pass freely into the air, past the raised air distributor cover. If after ignition has occurred the closure cap is pivoted down over the ignitor again, the air distributor cover is also automatically moved back to its original horizontal position, by means of the vertical connecting rod means.

It will be appreciated that the heating device may be exposed to rough treatment, for example on building sites, workshops and the like. For this purpose the heating device is provided with stabilising elements in order to ensure that the most important components such as the heating tube, the combustion chamber and the like remain firmly and air-tightly interconnected, even when the device is being transported, for example by means of a crane.

The stabilising mounting which is used for this purpose is economical and robust and ensures a firm connection between all the above-mentioned components, over a prolonged service period.

The stabilising mounting used has two struts which extend at a spacing from each other in the longitudinal direction of the heating device and which extend with their upper end to about the last fifth of the length of the heating tube, while their lower ends form two of three support legs of the heating device. The support legs terminate in support plates. The fuel container is mounted in a heat-insulated receiving vessel, and the bottom of that vessel is arranged at a spacing from the support plates on the support legs. The stabilising struts are extended through two of three side pockets of the receiving vessel, which pockets are arranged at regular spacings from each other in the periperhal direction of the vessel. The stabilising struts are firmly and oil-tightly connected, for example by welding, to flange plates which close off the side pockets at the upper and lower ends.

The third side pocket of the receiving vessel, that is to say the pocket which does not have either of the struts extending through it, also carries a support foot on its bottom flange plate and in its interior accommodates a filling connection pipe for the liquid fuel, such as a heating oil. The filling connection pipe opens into the fuel container at the bottom thereof. The fuel container may have the edge of its cover, which is welded onto the fuel container, secured by screw means to the edge of the receiving vessel.

The two struts extend at an angle inwardly and upwardly from the upper end of each of the above-mentioned side pockets. They are bent vertically upwardly at about the last third of their vertical length, and from there extend vertically upwardly. At this point they are fixedly connected to one half of a mounting ring for the heating tube, for example by means of welding, while the other half of the mounting ring is releasably connected to the first-mentioned half, for example by means of screws. In this way the whole mounting ring encloses and supports the heating tube, approximately at its centre halfway between its two ends. Therefore, after the removable half of the mounting ring has been released, the entire heating tube assembly together with the fuel container can be lifted out of the stabilising assembly comprising the struts, and thus out of the receiving vessel.

The two halves of the mounting ring can each be provided with a respective cantilever or outrigger member, which extend horizontally away in opposite directions. The cantilever member which is provided on the removable half of the mounting ring is substantially U-shaped to enclose the upper end of a heat protective cladding for the gas feedback tube, and this cantilever member is also strutted downwardly to the edge of the receiving vessel, by means of a support strut. A crane eye for lifting the heating device is connected to the cantilever member, which eye is pivoted upwardly in the operating position and pivoted downwardly in its operative position, into a position in which it extends substantially parallel to the cantilever member.

The two stabilising struts are advantageously in the form of hollow shaped members, for example hollow square or rectangular members, and in their upper region serve as guide means for two lowerable fixing struts. At their upper end the fixing struts are fixedly connected to a mounting ring for the above-mentioned air distributor cover, for example by welding. By releasing fixing screw means, for example in the form of wing nuts or other members, the fixing struts can be lowered, for increased safety in transportation and for reducing the length of the heating device, to such a level that the support ring together with the air distributor cover come to lie on the upper edge of the heating tube. This will also protect the interior of the heating tube from damp.

Further cantilever or outrigger member which is provided on said other half of the heating tube mounting ring, which is secured between the stabilising struts, carries a spacer bar, for example by means of an apertured strap member. The upper end of the spacer bar is connected to the edge of the air distributor cover while its lower end is secured for example by means of lock nuts. This arrangement provides that the spacer bar secures the correct distance intended between the air distributor cover and the upper edge of the heating tube, if the two fixing struts which carry the air distributor cover support ring, after having been lowered for transportation, are raised again for bringing the heating device into its operating position, and are then secured in their raised condition.

The robust stabilising mounting according to the invention ensures a satisfactory and lasting seal between all the connections of the various components of the heating device, such connections being absolutely essential for satisfactory operation of the heating device. In addition the strut system improves the transportability of the heating device insofar as a fork lift truck can lift the heating device by engaging it below the receiving vessel for the fuel container, due to the space which is present below the device. The device can be transported manually without difficulty, insofar as two or three persons can lift the device by means of the carrier ring around the device. Finally, a crane can be used to transport the device, due to the crane eye which is provided, the crane eye advantageously being so arranged that when the device is lifted by a crane it is in an inclined position so that the closure member on the filling pipe connection for filling the fuel tank with fuel is at the highest relative level.

BRIEF DESCRIPTION OF THE DRAWINGS

Embodiments of the invention will now be described by way of example with reference to the accompanying drawings, in which.

DESCRIPTION OF THE PREFERRED EMBODIMENTS

Figure 1:
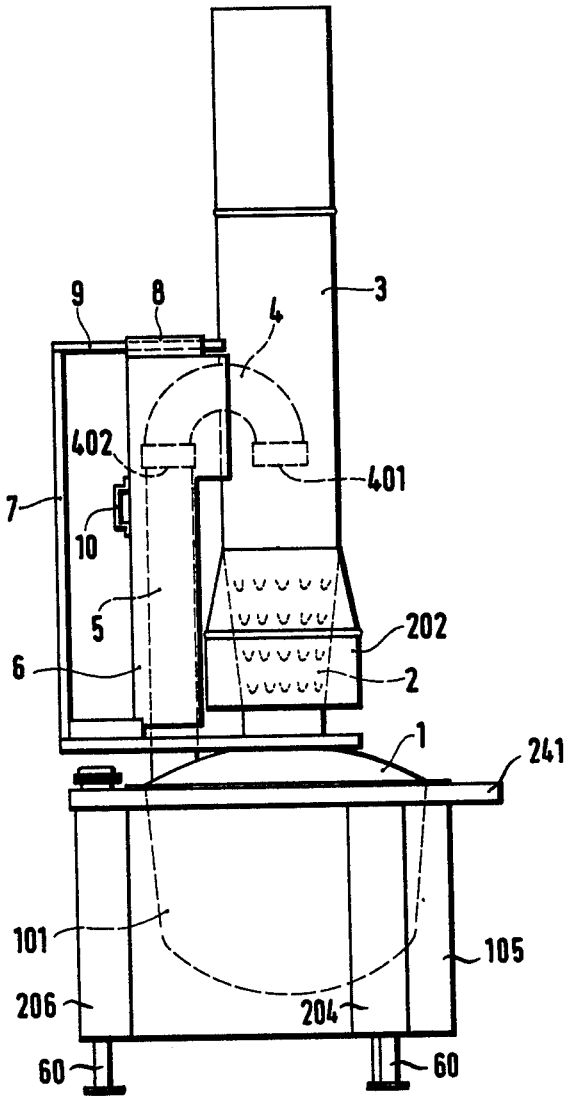
FIG. 1 shows aside view of a part of a heating device, with a horizontal displaceable heat protective sleeve for the gas feedback device, the sleeve being shown in the heat protective position.

Referring to the drawings, a combustion chamber 2 is arranged on a cover 1 of a fuel container 101 which also serves as an evaporation chamber. The fuel chamber 2 is clad with a means 202 for protecting it from wind or draft and heat. A vertical heating tube 3 is connected to the upper side of the combustion chamber 2.

Figure 7:
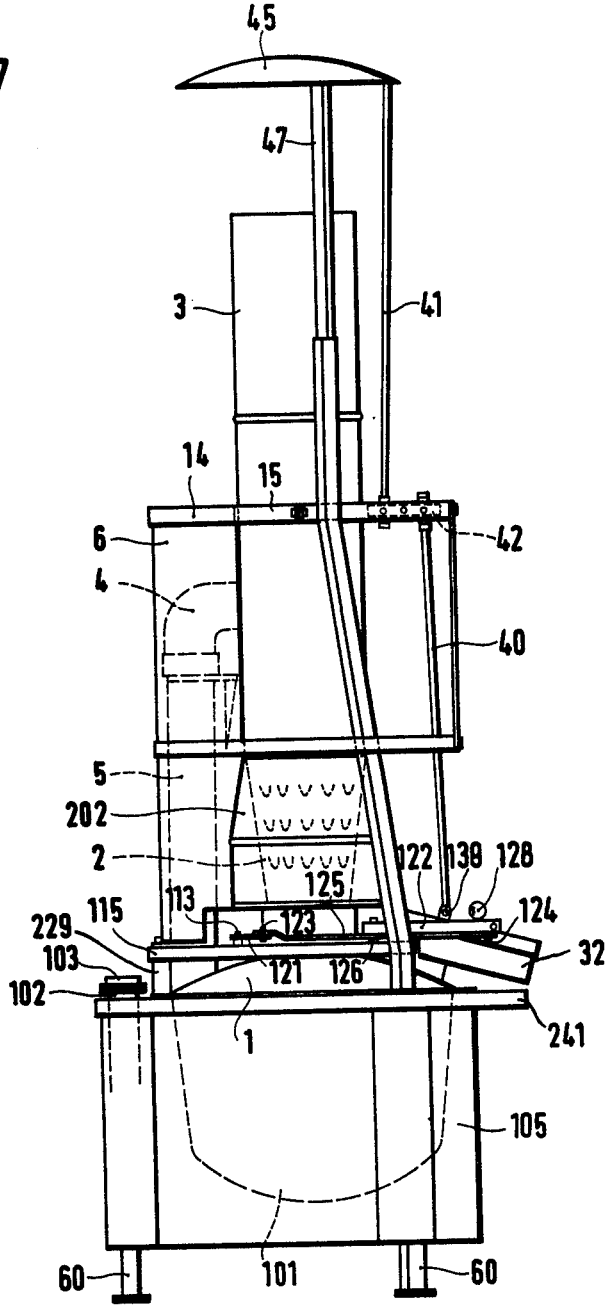
FIG. 7 shows a side view of a heating device with a safety device in its closed position.

The fuel is introduced into the fuel container 101 by way of a filling connection pipe 102 which can be closed by means of a cover 103 (see FIG. 7). The fuel container 101 is air-tight closed by means of the curved corner 1 and is suspended, being heat-insulated, in a receiving vessel 105 which is supported on a ground surface or the like by means of three legs 60.

The combustion chamber 2 is perforated and is fitted on top of the fuel container 1. The combustion chamber 2 is in communication with the interior of the fuel container 1, and the vertical heating tube 3 is connected to the perforated combustion chamber 2 for directly taking off the heating gases produced by the fuels which are evaporated in the fuel container 101 and burnt in the combustion chamber 2.

The heating device also has a gas feedback device comprising a curved tube or tube bend 4 which advantageously comprises a cast material, and a substantially straight gas feedback tube 5 which extends vertically parallel beside the heating tube 3. The tube bend 4 and tube 5 return a part of the gases passing through the heating tube 3, back into the fuel container 101, more specifically into the evaporation space or chamber in the container 101, above the surface of the fuel contained therein.

The tube bend 4 which is in the form of a 180° bend has one half arranged within the tube 3 in such a way that the mouth 401 of the tube bemd 4 is disposed centrally in the tube 3 and faces towards the upwardly open cone of the perforated combustion chamber 2, being arranged at a spacing therefrom, as clearly shown in FIG. 1. The other half of the tube bend 4 extends out of the side of the heating tube 3, in which it is air-tight fitted. The opening 402 of the second half of the tube bend is also air-tight connected to the upper end of the tube 5. The lower end of the tube 5 opens into the cover 1 of the evaporation chamber 101 and is air-tight secured thereto, for example by a flange connection.

For heat-insulation purposes, the half of the tube bend which is outside the heating tube 3, and the tube 5, are enclosed by a heat insulation or protective sleeve 6 which is open towards the heating tube 3. In this way the sleeve 6 radiates heat inwardly, such heat additionally acting on the tube bend 4 and the tube 5.

In order to prevent the excessive production of combustible heating gases which cannot be satisfactorily handled by the combustion chamber 2, which can occur in the initial period of operation of the heating device, for example within the first five hours of operation when the fuel in the container 101 is at a high level, the sleeve 6 can be displaced horizontally away from the heating tube 3, more precisely away from the tube bend 4 and the tube 5. For this purpose a vertically extending double frame 7 is secured on the heating device at a spacing from the sleeve 6. The upper end of the frame 7 carries two horizontal rails 9. These rails carry two slide members 8 which are secured at suitable points at the upper end of the sleeve 6. It will be appreciated that the arrangement can also be such that guide rails and slide members are provided at the lower end of the sleeve 6, which is generally of a one-part construction. On its part which encloses the tube 5 the sleeve 6 has an outside handle 10 by means of which the sleeve 6 can be drawn horizontally outwardly away from the tube 3 or the tube bend 4 and the tube 5.

With this arrangement it is possible for the tube bend 4 and the tube 5 to be partly or entirely liberated of the heat-insulating enclosure provided by the sleeve 6, so that as a result the temperature of the tube bend 4, which glows red when the sleeve 6 is closed, and also the temperature of the tube 5, and thus also the temperature action on the combustion gases in the evaporation chamber or container 101, can be reduced. This temperature action is advantageous as regards the production of combustion gases. If the tube bend 4 no longer glows, for example when the sleeve 6 is moved completely away therefrom as described above, this results in reduced production of fuel oil gas in the evaporation chamber 101.

Figure 2:
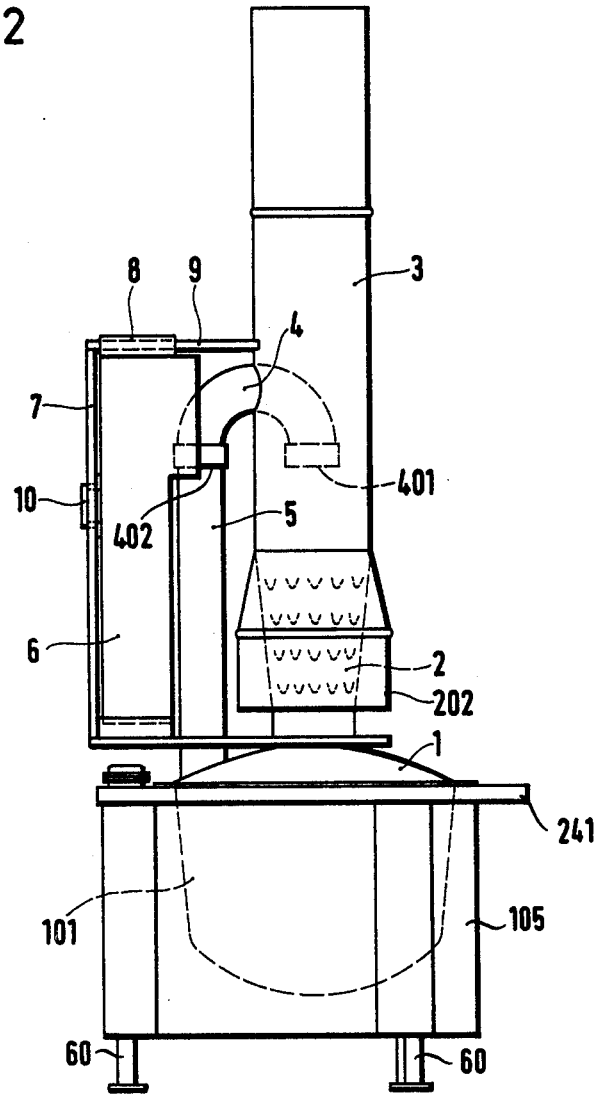
FIG. 2 shows the sleeve in the opened position.

The sleeve 6 is moved into the fully opened position shown in FIG. 2 when the heating device is set in operation, over the first period of operation, that is to say, during for example the first five hours of operation. During this period, because the level of fuel oil in the container 101 is high, it is only necessary to introduce a small amount of gas, and the heat required for producing such combustion gases can be obtained from the radiation heat of the flame in the combustion chamber 2. FIG. 1 however shows the position of the sleeve 6 which it assumes when the initial period of operation has passed and an increased feedback of high-temperature heating gases to the chamber 101 by way of the feedback tube 5 is required, because the fuel level in the chamber 101 has dropped, in order thus to maintain the total heat output substantially constant. It will be appreciated that the sleeve can also be set into intermediate positions between the two limit positions shown in FIGS. 1 and 2 respectively; for example when the heating device is used in the open air, for the first period of operation when the level of fuel in the chamber 101 is high, it is only necessary for the tube bend 4 and the tube 5 to be partly insulated by means of the sleeve 6. In that case the heating action of the heating gases from the heating tube 3 on the feedback tube 5 will be reduced in the desired manner.

Figure 3:
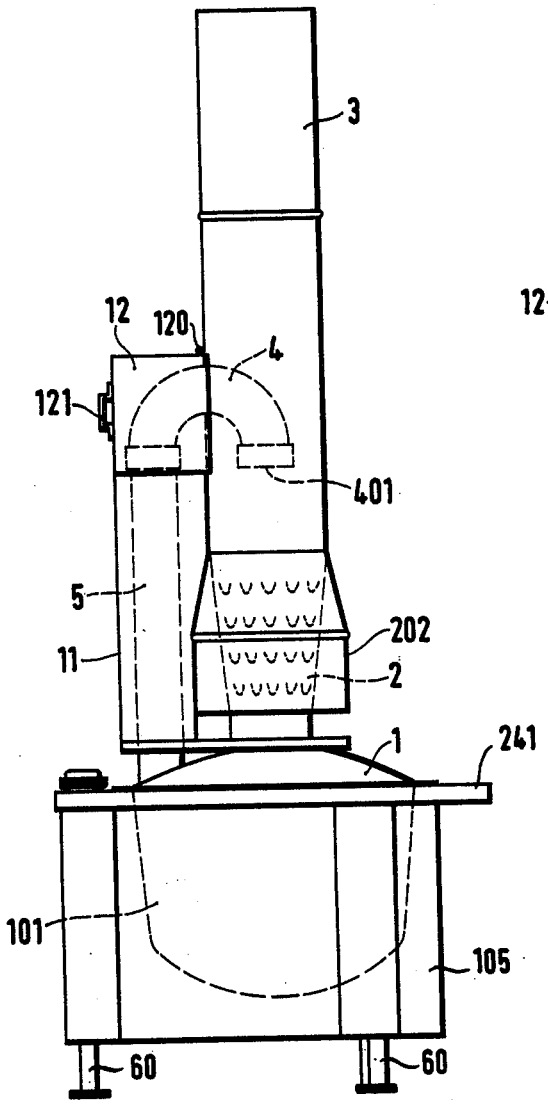
FIG. 3 shows a modified embodiment of the invention with a two-part protective sleeve, showing a heat protective cap in a closed position.
Figure 4:
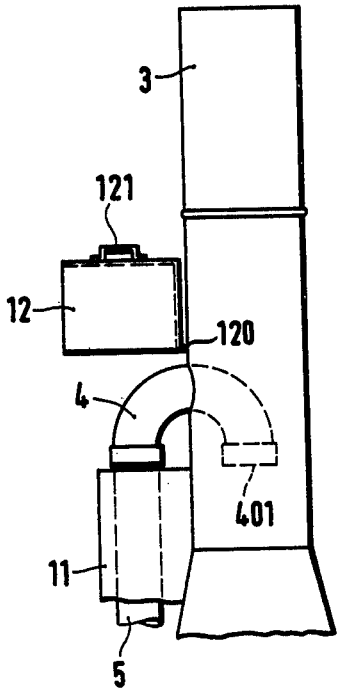
FIG. 4 shows the cap in an opened position.

In the construction shown in FIGS. 3 and 4, the heat protective device for insulating the gas feedback assembly comprising the components 4 and 5 is of a two-part construction, comprising a heat protective sleeve 11 and a heat protective cap 12 which is connected to the sleeve 11 at the upper end thereof. The sleeve 11 which is open towards the heating tube 3 encloses the tube 5, while the cap 12 covers the portion of the tube bend 4 which is outside the heating tube 3. The cap 12 is pivotally connected, as shown in FIG. 3, to the heating device, for example to the heating tube 3, by means of a horizontal spindle 120 which is fixed on the heating tube, and can therefore be pivoted from the downwardly pivoted closed position of FIG. 3 into the upwardly pivoted open position of FIG. 4. It can then be secured in the open position. The resulting intensive heat regulation action which affects in particular the tube bend 4 which tends to glow red in the closed position of the cap 12 (FIG. 3 position), provides that when the cap 12 is pivoted up during the first period of operation, for example the first 5 hours of operation, the excessive production of fuel oil gases within the evaporation chamber 101 is avoided. When the first period of operation has passed and the level of fuel oil in the container has gone down, the cap 12 is pivoted downwardly from the FIG. 4 position to the FIG. 3 position, in order additionally to heat-insulate the tube bend 4. In this way the heating gases which are passed back to the evaporation chamber 101 through the tube bend 4 and the tube 5 are kept at a higher temperature than previously, and accordingly a greater amount of gas is produced in the evaporation chamber 101. In this way the heat output of the heating device can be kept substantially constant, over its entire period of operation.

In extreme cases it is finally also possible not only for the cap 12 to be pivoted upwardly to the FIG. 4 position, by means of the handle 121, during the initial period of operation, but also for the sleeve 11 to be removed from the tube 5 during that period.

Figure 5:
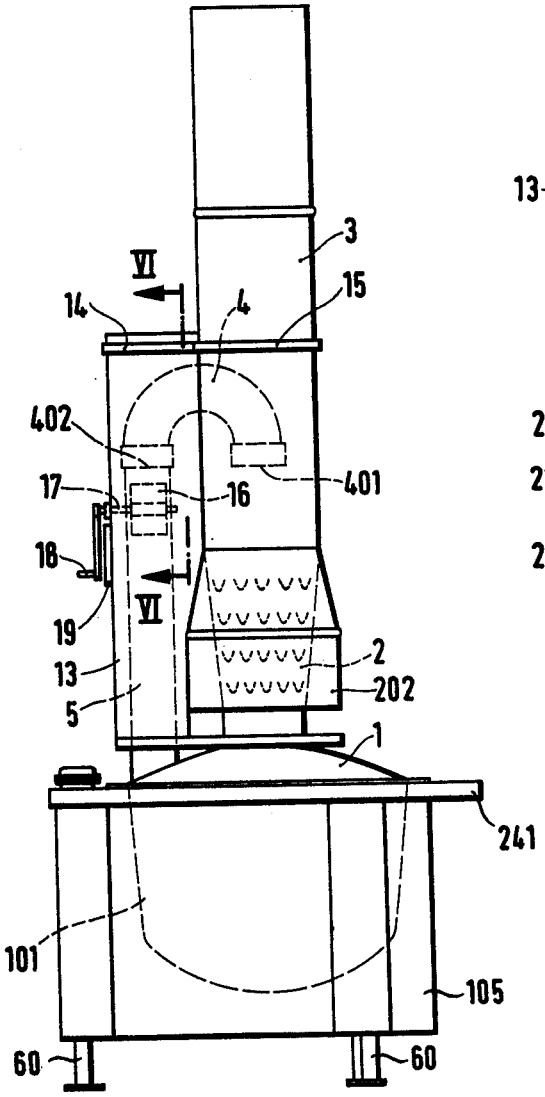
FIG. 5 shows a further embodiment of the invention with a one-piece heat protective sleeve and a regulating flap in the gas feedback tube.

In the further modified embodiment of FIG. 5, the device has a one-part heat protective sleeve 13, just as in the embodiment of FIGS. 1 and 2, in order to provide for an adjustable heat insulation for the gas feedback device 4 and 5. The sleeve 13 completely encloses the cast tube bend 4 and the tube 5 and is open towards the tube 3. However, unlike the FIGS. 1 and 2 embodiment, the sleeve 13 is not arranged so as to be displaceable in a horizontal direction, but is secured to the heating tube 3 inter alia by means of a cantilever or outrigger member 14 of a mounting ring 15 for the heating tube 3, which member 14 embraces the upper end of the sleeve 13.

In the FIG. 5 embodiment, the sleeve 13 normally remains in its mounting as the reduction in heat output or the reduction in temperature or amount of the heating gases which are fed back to the evaporation chamber by way of the tube bend 4 and the tube 5 is effected during the above-mentioned first period of operation, by means of a regulating flap 16. The flap 16 is mounted pivotally about a horizontal shaft 17 in the interior of the tube 5. In this way the internal flow cross-section of the tube 5 can be left completely open or can be reduced in size in a stepless manner, in order to control the amount and the temperature of the heating gases, and thus also the heat content thereof. As mentioned above, the heating gases are fed back to the evaporation chamber 101 by way of the tube bend 4 and the tube 5 which in this embodiment are completely heat-insulated by means of the sleeve 13. A handle 18 is extended outwardly of the sleeve 13 from the spindle 17 which pivotally carries the flap 16. The flap 16 can thus be actuated by means of the handle 18, in conjunction with a scale 19 provided on the outside of the sleeve 13. It will be seen therefore that, as in the embodiments described above, during the first period of operation of the heating device the flap 16 is manually actuated by means of the handle 18 to a position in which it reduces the effective internal flow cross-section of the tube 5 in such a way as to provide the desired reduction in the heat output of the fed-back gases, with respect to the excess production of heating gases, during the first period of operation. After the said first period of operation has expired, the flap 16 is then moved by means of the handle 18 to a position in which it does not in any way block the effective flow section of the tube 5. In the embodiment shown in FIG. 5 this position corresponds to the flap 16 being disposed vertically within the tube 5.

Figure 6:
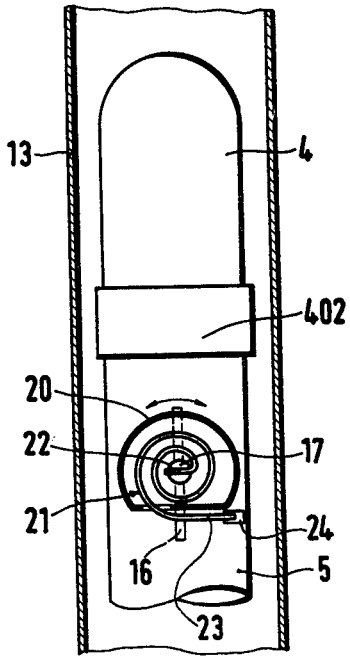
FIG. 6 shows a view of a modified embodiment of the FIG. 5 construction, viewed on line VI—VI in FIG. 5.

In the FIG. 6 embodiment the flap 16 is actuated automatically and steplessly. For this purpose the horizontal spindle 17 supporting the flap 16 in the tube 5 is extended outwardly, that is, towards the heating tube 3, into a housing 20 in which there is a spiral bimetal spring 21. One end 22 of the spring 21 is secured to the spindle 17 while the other end 23 of the spring 21 is extended out of the housing 20 and is suitably secured to a point 24 on the tube 5, so that the temperature of the tube 5, and the bimetal spring 21, automatically produce a suitable control of the flap 16, by causing a pivotal movement thereof. The arrangement is such that during the first period of operation the flap 16 reduces the flow section of the pipe 5 in the desired manner, whereas in the second period of operation the flap 16 assumes the vertical position for example, as shown in FIG. 6. Between these two positions the flap 16 can obviously be adjusted steplessly by means of the spring 21. The end 23 of the spring 21 can obviously be suitably adjusted so as to bring the flap 16 into an appropriate starting position, for operation at the beginning of the first period of heating operation.

This automatic regulation by means of the flap 16, as in the embodiment of FIG. 6, is technically only required when the gas feedback device is such that the tube bend 4 and the tube 5 are enclosed and completely heat-insulated by means of the sleeve 13. This is because, with such a gas feedback device, the regulating flap 16 is operative during the first period of operation to reduce the heat output, relative to the excessive production of heating gases. In that case the tube bend 4 and the tube 5 require heat insulation in the form of the sleeve 13, in order to ensure that a uniform amount of heating gases is produced, and thus also there is a uniform heat output, while the fuel oil level within the chamber 101 is gradually going down. It is assumed in this case that the evaporation system is so designed that the oil is evaporated without resorting to any flame or fire burning on the surface of the oil, thereby to achieve soot-free combustion.

Figure 8:
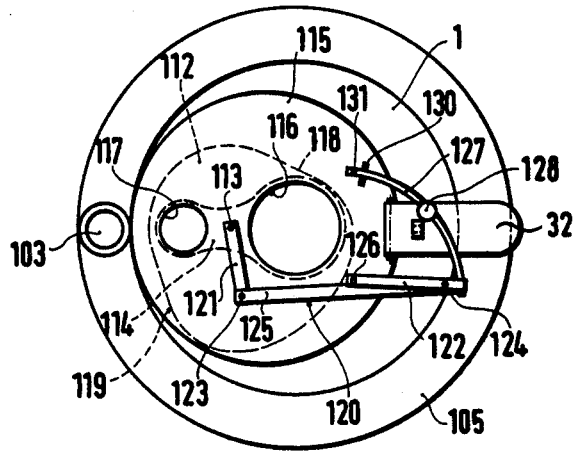
FIG. 8 shows a plan view of the safety device in the closed position.

Reference will now be made to FIGS. 7 to 10, which show that a plate housing 112 is fixedly connected to the top side of the cover 1 of the fuel container 101 (evaporation chamber). Mounted in the housing 112 is a shut-off slide plate 114 which is rotatable about an axis 113 (see in particular FIGS. 8 and 9). The housing 112 is covered by means of the cover plate 115 at its top side (see FIG 7). As shown in FIG. 8 and in particular in FIG. 9, two circular openings 116 and 117 are provided in the housing 113, the openings being of different diameters. The opening 116 corresponds to the cross-sectional configuration of the heating tube 3 and connects the tube 3 to the fuel container 101, while the opening 117 corresponds to the cross-sectional configuration of the gas feedback tube 5 and air-tight connects same to the container 101. The arrangement is such that the container 101 is air-tight connected to the tube 5 and the tube 3 respectively. For this purpose the housing 112 is advantageously secured to the top of the cover 1 by welding.

Figure 9:
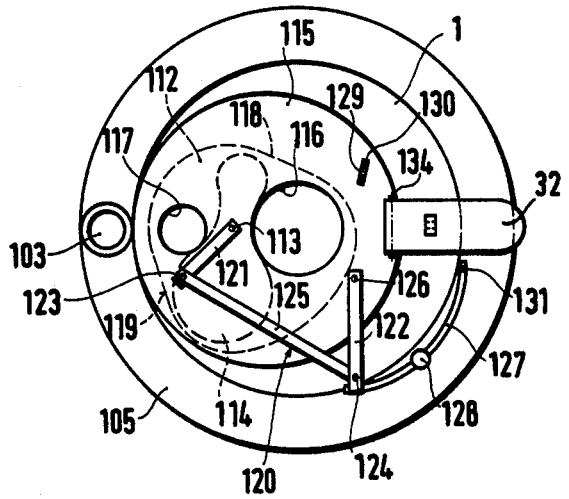
FIG. 9 shows a plan view of the safety device in the open position.

The slide plate 114 is in the shape of a crank web, as is clearly shown in FIGS. 8 and 9, and can be disposed in the closed position of FIG. 8 or in the open position of FIG. 9. In the closed position, which is defined by a side wall 118 of the housing 112 serving as an abutment for the side edge of the slide plate 114, the openings 116 and 117 and thus the cross-sections of the tube 3 and the tube 5, are completely closed, as shown in FIG. 8, so that the fuel cannot evaporate or be burnt and the heating device is out of operation. In the open position of the plate 114, which is defined by another side wall 119 serving as an abutment for an edge of the plate 114, the openings 116 and 117 and thus the tubes 3 and 5 are fully open, as shown in FIG. 9, so that operation of the heating device is fully enabled.

The heating device also has a pivotal lever assembly 120 with two pivotal levers 121 and 122, for actuating the slide plate 114 into its closed or open position. The levers 121 and 122 are pivotally connected by pivots 123 and 124 to respective ends of a connecting lever 125 which interconnects the two pivotal levers. At its end remote from the pivot 123 the lever 121 is non-rotatably connected to the plate 114 by way of the shaft 113, while at its end 126 remote from the pivot 124 the lever 122 is connected fixedly, that is to say, to cover plate 115 on the housing 112.

At the end of the lever 122 adjacent the pivot 124 there is secured a locking bracket member 127 which is of a circular arc configuration and which carries an actuating knob or handle 128 for actuating the lever assembly 120.

Secured to a point on the plate 115 which lies in the range of pivotal movement of the locking member 127 is a bar 130 which has an opening 129 through which the locking member 127 extends, in the closed position of the slide plate 114 as shown in FIG. 8. At its free end the locking member 127 has a bore or aperture 131 for receiving a locking device such as a bolt with a nut, a padlock or the like, in order in this way to prevent unauthorised release of the locking member 127 from its securing position which corresponds to the closed position of the slide plate 114.

Figure 11:
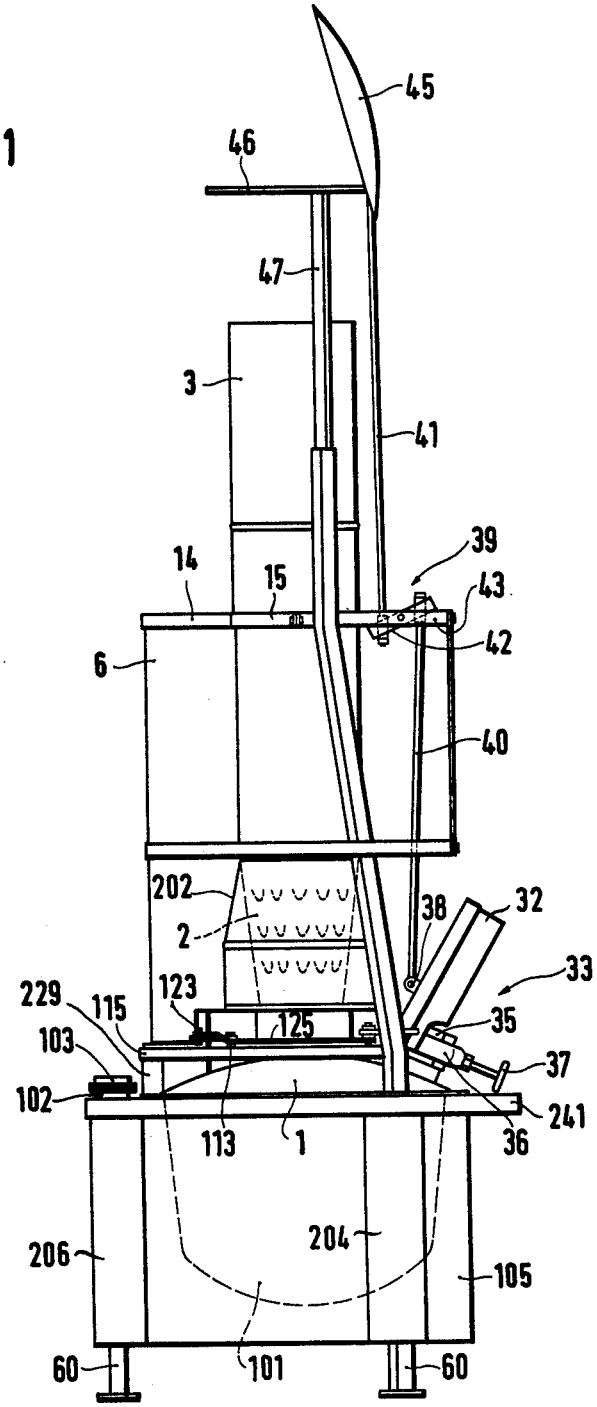
FIG. 11 shows the closure cap for the igniter in the raised position.

In the securing position of the locking member 127 as shown in FIG. 8, the locking member 127 engages over a closure cap 32 of an igniter 33 which is shown in FIG. 11. In the release position of the locking member 127 as shown in FIG. 9, corresponding to the open position of the slide plate 114, the closure cap 32 is released. Therefore the locking member 127 is of such a length that in the securing position it extends through the opening 129 in the bar 130, but on the other hand it no longer engages over the top of the closure cap 32, in the release position of the locking member.

The cap 32 is mounted so that it can be pivoted between a raised and a lowered position, by means of a spindle 131 which is mounted horizontally on the plate 115. In its closed position as shown for example in FIGS. 7 and 10, the cap 32 covers the igniter 33 so that the igniter cannot be actuated. The igniter 33 substantially comprises an igniter connection 35 which is extended out of the cover 1 of the container 101 and which has an opening that can be steplessely increased or reduced by means of an ignition slide member 36 by way of a hand wheel 37; it will be appreciated that the said opening can also be completely closed or completely opened. As shown in FIG. 11, the igniter 33 is arranged at the side of the heating device which is remote from the fuel filling connection 102.

One end of a vertical connecting rod assembly which comprises two levers 40 and 41 and a rocking lever 42 connecting the levers 40 and 41, is pivotally connected to the top of the cap 32, at a suitably constructed mounting 138. The lever 42 is mounted rotatably at its centre on a cantilever or outrigger member 43 of a mounting ring 15 for the tube 3.

The end of the lever 40 which is remote from the mounting 138 is pivotally connected to one end of the lever 42, while the other end of the lever 42 is pivotally connected to one end of the lever 41. The other end of the lever 41 is pivotally connected eccentrically to an air distributor cover 45 which lies on a circular support ring 46 (see FIG. 11) disposed at a spacing from the free end of the tube 3. The ring 46 is connected to and thereby supported by the upper ends of two strut mountings 47 which can be lowered for transporting the heating device.

The above-described safety device operates in the following manner.

If a heating device which is in operation is to be shut down, the cross-sections of the heating tube 3 and the feedback tube 5, or the corresponding openings 116 and 117, must be air-tight closed. This is achieved by the slide plate 114 being moved from its FIG. 9 open position to its FIG. 8 closed position. For this purpose the lever assembly 120 is pivoted in the counter-clockwise direction by means of the actuating knob 128, until one edge of the slide plate 114 abuts against the side wall 118 of the housing 112 and in this position thus closes the openings 116 and 117.

In the FIG. 8 closed position of the plate 114, the locking member 127 is also in its securing position as it engages over the top of the closure cap 32 (which is usually pivoted upwardly), while on the other hand the free end of the locking member 127 extends through the opening 129. In this position the locking member 127 can be secured against unauthorised opening by inserting a locking device into the aperture 131 at the free end of the locking member 127. Accordingly, in this position of the locking member 127 it is not possible to operate the heating device as the tube 3 and the tube 5, or the corresponding openings 116 and 117, are closed by the slide plate 114, and on the other hand the downwardly pivoted cap 32 cannot be opened so that it is not possible to ignite the heating device by means of the igniter 33.

If now the heating device is to be set in operation and the liquid fuel, for example oil, which is in the container 101, is to be ignited, the lever assembly 120 is moved from the position of FIG. 8 to the position of FIG. 9, by a pivotal movement in the clockwise direction by means of the actuating knob 128, until the slide plate 114 has its corresponding edge abutting against the side wall 119 of the housing 112. This releases the openings 116 and 117 so that the cross-sectional flow areas of the tubes 3 and 5 are fully available. In addition however, the locking member 127 is also moved from its securing position to its release position as shown in FIG. 9 so that the cap 32 can now be raised and the igniter 33 is accessible. The ignition slide member 36 can now be turned up by means of the hand wheel 37 and thus the opening of the ignition connection 35 can be enlarged to the desired dimension, in order to ignite the surface of the oil in the container 101, by means of spirit which is introduced through the ignition pipe 35, and a fuse or match.

In this position, that is to say, when the locking member 127 is released and the cap 32 is raised, the cover 45 is also lifted from its ring 46 and pivoted into the FIG. 11 position, by means of the lever 40, the lever 42 and the lever 41 of the lever assembly 39.

Now, if a heating device which has not cooled down and which has heating gases in the evaporation chamber of the container 101 should be ignited, contrary to existing safety provisions, and thereby exhaust discharge or explosion should occur, this does not exit through the relatively narrow opening of the ignition connection or aperture 35 which is towards the operator. On the contrary, such discharge or explosion will follow the path of least resistance and will pass through the opened cross-sectional areas of the tubes 3 and 5 upwardly to the free end of the heating tube 3, far above the head of the operator, while in addition the resistance to exhaust discharge or explosion as mentioned above is removed or reduced to a minimum by virtue of the fact that the air distributor member 45 is also raised into its upward position, by virtue of the cap 32 also being in its raised position.

After the heating device has been ignited and after the period of time provided for by the operating provisions of the heating device has passed, the ignition connection or aperture 35 is closed by means of the ignition slide member 36 by actuation of the hand wheel 37, and the cap 32 is pivoted into its down and thus closed position. At the same time the air distributor cover 45 is pivoted downwardly, by means of the connecting assembly 39, and is thus brought to rest on the ring 46. When the heating device is later taken out of operation, all the components of the safety device are then returned to the safety position shown in FIG. 8.

Referring now to FIGS. 12 to 15, it will be seen that the vessel 105 receiving the container 101 is substantially cylindrical and on its outer periphery, at regular spacings in the peripheral direction, it has side pockets or receptacles 204, 205 and 206 which are bulged out of the side of the vessel 105. The side pocket 206 accommodates the oil filling connection 102, which is closed by means of the closure member 103 and which extends to the bottom of the container 101, so that the container 101 can be filled up with fuel oil even while the heating device is in operation.

The vertically upwardly extending heating tube 3 is fitted air-tight on the combustion chamber 2, and the gas feedback tube 5 which extends parallel to the heating tube 3 is returned and air-tight connected to the container 101. In this case the tube 5 and the container 101 are connected by the completely closable opening 117 shown in FIGS. 8 and 9. The tube 5 also has the heat insulating cladding or sleeve 6.

FIGS. 12 to 15 also show in detail that the heating device has a stabilising mounting which extends over almost its entire length, as considered in a vertical direction. The stabilising mounting comprises two generally vertically extending strong struts 214 and 215 which are arranged at a spacing from each other. The lower end region of the struts 214 and 215 is fixedly connected to the vessel 105 while in their upper region the struts support the tube 3. As is particularly clearly shown in FIGS. 14 and 15, the struts 214 and 215 are arranged at spacings of about 120° relative to each other in the peripheral direction of the vessel 105, and extend through two of the three side pockets 204 to 206, for example the side pockets 204 and 205 as shown, where they are secured. For this purpose the struts 214 and 215 which extend vertically in the region of the side pockets 204 and 205 are passed through upper flange plates 217 and lower flange plates 218 respectively on the side pockets 204 and 205, and are oil-tight secured thereto for example by welding. The plates 217 and 218 are in turn secured to and close upper and lower ends respectively of the side pockets, being secured for example by means of welding.

The struts 214 and 215 are extended downwardly out of the lower plates 218 of the respective side pockets 204 and 205 and there form the support legs 60 which terminate in support plates 220. Correspondingly, the side pocket 206 which carries the filling connection 102 is also closed at its upper and lower ends by means of corresponding flange plates, and at its end which is towards the ground it has a third support leg 60 which also has a support plate 222. By virtue of the space between the bottom of the heating device and the ground, as provided by means of the support legs 60, it is readily possible for a fork lift truck to engage under the heating device and to convey it to some other desired position.

Figure 12:
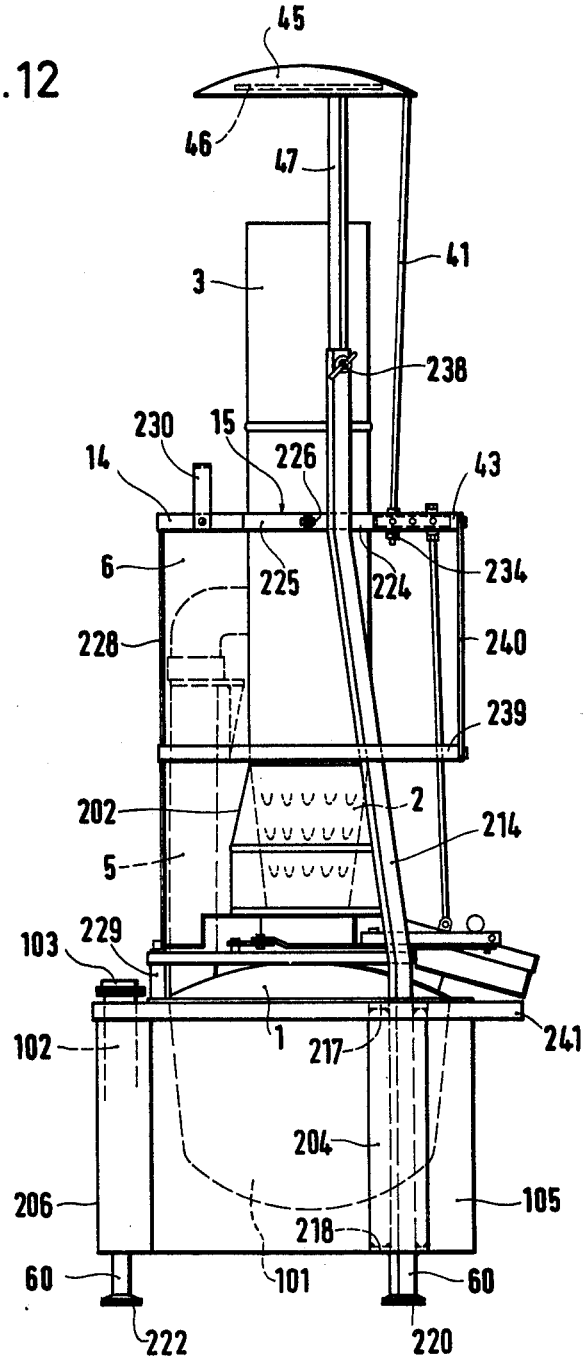
FIG. 12 shows a stabilising mounting in side view.
Figure 13:
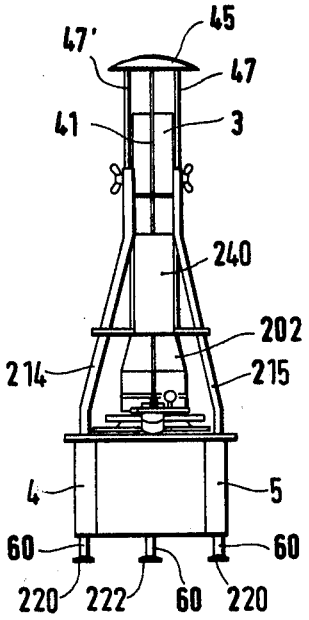
FIG. 13 shows a front view of the stabilising mounting, this view being on the igniter side of the heating device.
Figure 14:
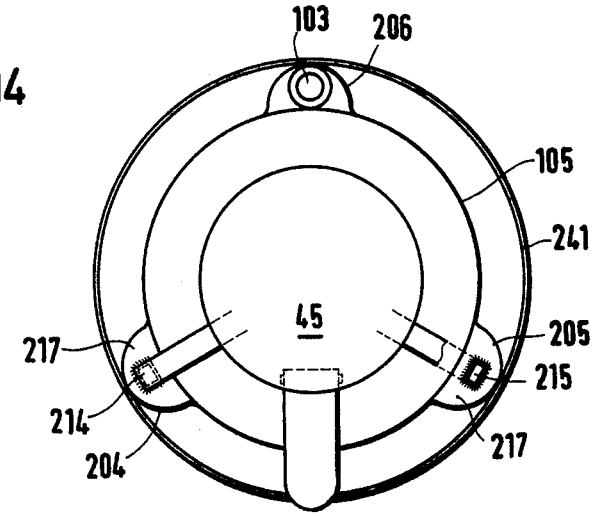
FIG. 14 shows a diagrammatic plan view of the heating device, showing the arrangement of the side pockets or receptacles of the fuel container receiving vessel.
Figure 15:
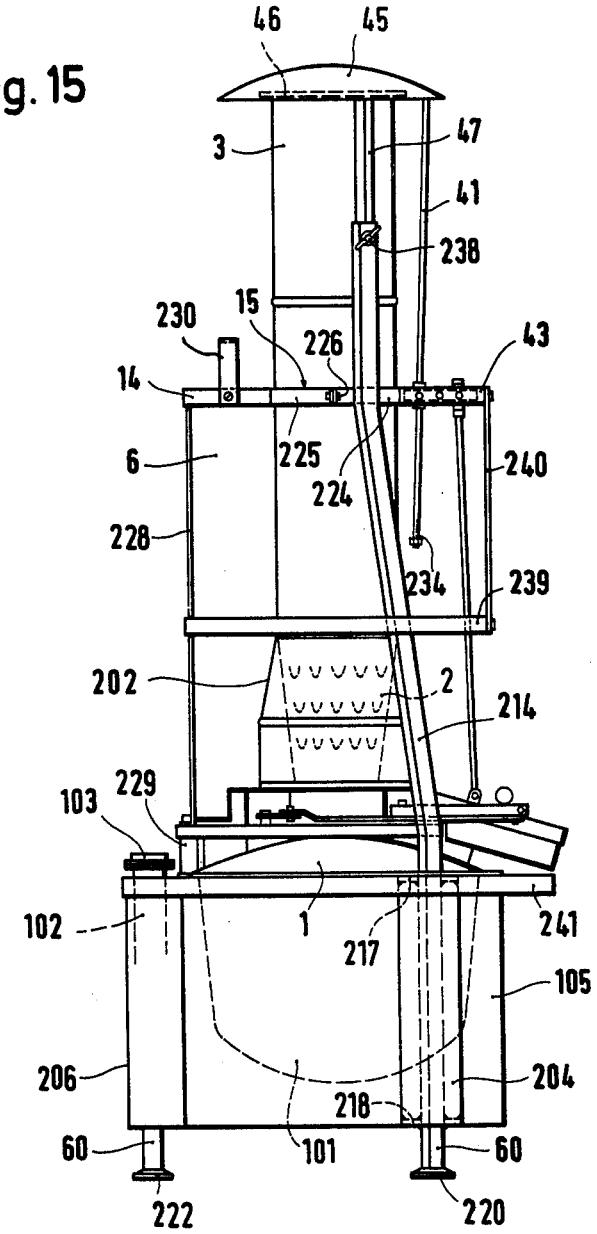
FIG. 15 shows a side view of the stabilising mounting with the heating device in its condition for transportation.

The struts 214 and 215 extend from their respective side pockets 204 and 205 at an angle inwardly and upwardly as shown in FIGS. 12, 13 and 15, the inclined portions of the struts extending to approximately halfway up the vertical heating tube 3. From that position they then extend vertically upwardly substantially parallel to the heating tube 3, and terminate approximately at the lower end of the last fifth of the vertical height of the heating tube 3. As is particularly clearly shown in FIG. 14, the struts 214 and 215 are in the form of hollow square members, although it will be appreciated that any other appropriate shaping of the struts may be employed. The horizontal mounting ring 15 which embraces and supports or mounts the heating tube 3 approximately half-way therealong is disposed at the bend point between the inclined and the vertical portions of the struts 214 and 215, towards the upper end thereof. The ring 15 is in two parts, as described above, comprising halves 224 and 225. The half 224 is welded to the struts 214 and 215, while the other half 225 is releasably secured by screws 226 to the half 224. In this way it is possible for the major components of the heating device, namely the heating tube 3 fitted on the combustion chamber 2, together with the container 101, to be inserted as a unit into the vessel 105 and there secured or retained, by the two halves 224 and 225 of the ring 15 being connected together.

At the side of the heating device which is towards the filling connection 102, a horizontally outwardly extending cantilever or outrigger member 14 is secured to the releasable half 225 of the mounting ring 15. The cantilever or outrigger member 14 is of a U-shape and engages around the sleeve 6 of the tube 5 and holds same, and is supported at its outer end by a strut 228. The strut 228 is extended by way of an auxiliary strut member 229 to the upper edge of the vessel 105. Pivotally connected to the member 14 is a crane eye 230 which can be pivoted upwardly into its operative position as shown in FIGS. 12 and 15, so that the heating device can be raised or transported by means of a crane, and can advantageously be pivoted downwardly into an inoperative position in which it extends substantially parallel to the member 14. If the heating device is to be lifted by means of the crane eye 230, because the crane eye is at the side of the device which is towards the filling connection 102, the heating device will tend to assume an inclined position in which the closure member 103 of the filling connection 102 is at a higher level than the upper ends of the other two side pockets 204 and 205. This will reliably prevent the liquid fuel in the container 101 from flowing out through the pipe connection 102.

Figure 10:
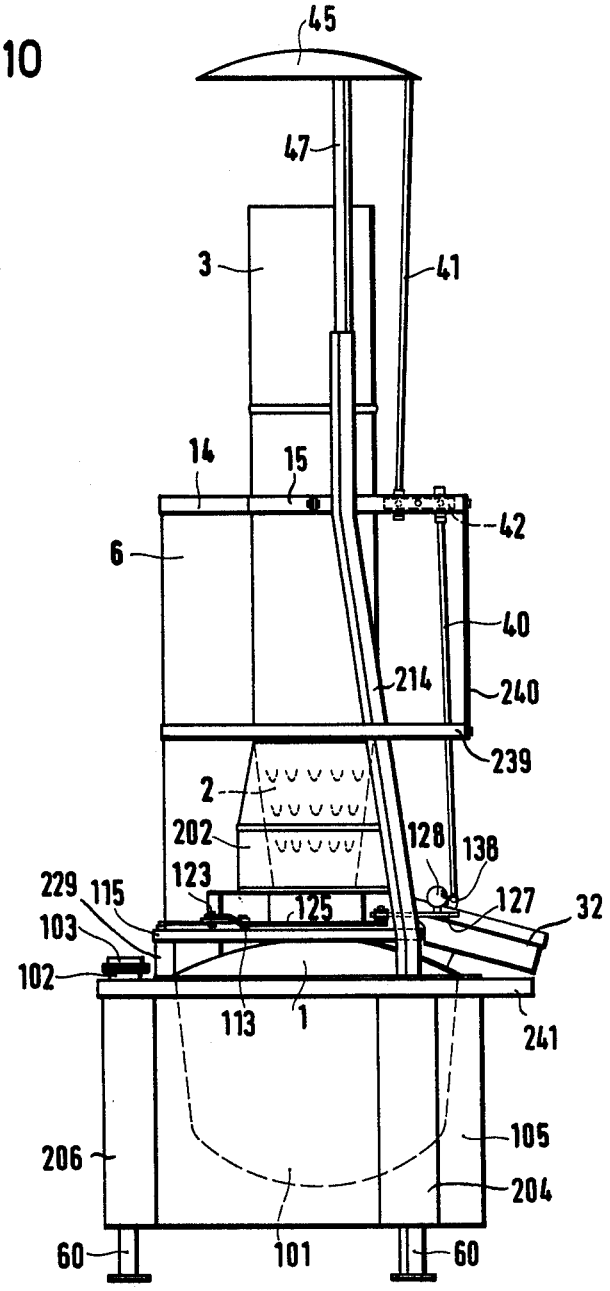
FIG. 10 shows a side view of the heating device with the safety device in its open position, and with a closure cap in a downwardly pivoted position, for the igniter.

At the side of the heating device from the crane eye 230, the ring half 224 which is secured between the struts 214 and 215 has a cantilever or outrigger member 43 which extends horizontally outwardly and which carries the substantially vertical spacer bar or lever 41, as shown in FIGS. 10 and 11. The bar or lever 41 is pivotally connected at its upper end to the air distributor cover 45, adjacent the edge thereof, the member 45 usually being at a spacing from the upper edge of the heating tube 3, as shown. At its lower end the bar 41 has adjustable securing means, for example in the form of locknuts 234, by means of which the effective length of the bar 41 can be so determined that the position of the member 45 above the upper edge of the heating tube 3 can be precisely set. The member 45 is mounted on a ring 46 and can be pivoted upwardly therefrom, as described above. The ring 46 is secured to the upper ends of two struts 47 and 47'. The struts 47 and 47' are of a shape which corresponds to the cross-sectional shape of the struts 214 and 215 and are fitted into the upper open ends of the struts 214 and 215, where they extend vertically above the ring 15. This means that the struts 47 and 47' are vertically displaceably supported by the upper region of the struts 214 and 215.

In the usual position of the heating device, that is to say, when it is not to be transported, the member 45 is at a predetermined distance above the upper end of the heating tube 3 so that the sturts 47 and 47' are extended out of the struts 214 and 215 by a corresponding distance. In this position the struts 47 and 47' are secured relative to the struts 214 and 215 by suitable fixing means, for example by respective wing nuts 238. At the same time, as already mentioned, the predetermined distance of the member 45 above the tube 3 is determined by the adjusted length of the spacer bar 41. In the position of the member 45 shown in FIG. 12, the bar 41 is also secured to the member 43 in the set position, by fixing means (not shown).

If the heating device is to be transported, the member 45 is moved into the FIG. 15 position in which it is lowered onto the upper edge of the heating tube 3, in order to provide for safe transport for the member 45 and for protecting the interior of the heating tube 3 from damp. In order to lower the member 45 into the FIG. 15 position, the fixing means provided on the struts 47 and 47' are released and the struts, together with the bar 41, are then lowered until the ring 46 or the member 45 lie on the upper edge of the heating tube 3. When the heating device is then to be set in operation, it is only necessary for the member 45 to be raised again by means of the struts 47 and 47' and the bar 41, until the member is again at its predetermined distance above the tube 3.

As shown in the drawings, the device also has a carrier ring 241 which serves as a peripheral handling means, for manual transportation of the device. The ring 241 is welded to the three side pockets 204 to 206 in the region of the upper ends thereof, and radially protects and extends around the heating device.

Also secured to the struts 214 and 215 at a distance below the ring 15 is a ring 239 serving to prevent contact with sensitive parts of the device. The ring 239 extends directly above the combustion chamber 2 and is secured to the support strut 228 which extends between the vessel 105 and the member 14. Secured between the ring 239 and the member 43 is a vertically extending board or plate 240 of substantial size, for receiving the operating instructions for the heating device. As the component 240 is at a sufficient distance from the heating tube 3, the heating action produced by the tube 3 will not impair the legibility of the operating instructions on the component 240.

What is claimed is:

1. In a heating device comprising: a fuel container including a cover in which a liquid fuel such as oil can be evaporated within an evaporation chamber formed by said fuel container and its cover; a combustion chamber connected on the fuel container, for combustion of the evaporated fuel; a heating tube connected to the combustion chamber, for carrying combustion gases therefrom; and a gas feedback means air-tightly connecting the heating tube to the evaporation chamber, for returning to the evaporation chamber a part of the combustion gases in the heating tube, thereby to cause evaporation of fuel during operation; the improvement wherein the gas feedback means is controllable to regulate the amount of heat introduced into the evaporation chamber by the feedback gas, thereby to maintain said amount at a substantially constant level, air-tight connections between said combustion and said evaporation chambers and between said combustion chamber and said heating tube, and wherein mechanical support means in the form of a separate framework connected at least between said fuel container of said heating tube for sustaining the respective air-tight connections between the evaporating chamber and the combustion chamber and between the heating tube and the combustion chamber, both during heating operation and also during transportation of the heating device.

2. A device according to claim 1 wherein the gas feedback means includes a gas feedback conduit and a heat protective means for variably enclosing the conduit, thereby to control the amount of heat fed back to the evaporation chamber by the gas passing through the conduit.

3. A device according to claim 1 wherein the gas feedback means comprises a tube bend which is extended out of the heating tube and which is connected to a substantially rectilinear gas feedback conduit opening into the evaporation chamber, and wherein the part of the tube bend which lies outside the heating tube, and the gas feedback conduit, are enclosed by a heat protective sleeve which is open towards the heating tube and which variably encloses the tube bend and the conduit, thereby to regulate said amount of heat to said substantially constant level

4. A device according to claim 3 wherein said sleeve is of a one-part construction and is removable from the gas feedback means.

5. A device according to claim 1 wherein said heating tube and a gas feedback conduit forming part of said gas feedback means are each connected to the fuel container including the evaporation chamber, by way of respective apertures, the device further including an igniter provided at the top of said fuel container and comprising an ignition connection aperture opening into said fuel container and having an ignition slide member, for closing said aperture, a disabling means for rendering said igniter inoperative and a shut-off closure means displaceable between a first position in which the first mentioned apertures are closed and a second position in which both said first mentioned apertures are open, the shut-off closure means being operatively connected to said disabling means whereby when said shut-off closure means is in its aperture-closing position said igniter is rendered inoperative while in the aperture-opening position of the shut-off closure means the igniter is enabled for ignition operation.

6. A device according to claim 5 wherein said shut-off closure means is in the form of a slide plate actuatable by means of a pivotal lever assembly, said assembly including a locking member for disabling the igniter, the locking member engaging over the igniter when the closure means is in its aperture-closing position.

7. A device according to claim 6 wherein said lever assembly comprises a first pivotal lever which is non-rotatably connected to the rotary shaft of the closure plate, a second pivotal lever which is pivotal about a stationary point, and a third lever which interconnects said first and second levers, and wherein said locking member is of an arcuate configuration and is carried by said second pivotal lever.

8. A device according to claim 6 wherein said locking member has an actuating knob for actuating said lever assembly.

9. A device according to claim 6 wherein said igniter disabling means includes a closure cap for covering the igniter to prevent operation thereof, and wherein in the aperture-closing position of the closure plate the locking member prevents opening of said closure cap.

10. A device according to claim 5 wherein said igniter disabling means includes a fixed member having an aperture and wherein, in the locking position of the locking member, corresponding to the aperture-closing position of the closure plate, the free end of the locking member engages into said aperture.

11. A device according to claim 10 wherein said free end of the locking member has an opening for receiving a lock means thereby to secure the locking member in said aperture and to prevent unauthorised operation of said igniter.

12. A device according to claim 9 wherein said closure cap is openable by a pivotal movement about a horizontal axis, wherein a vertical connecting assembly is pivotally connected to the top of the closure cap thereby to connect the closure cap to an air distributor member provided at a spacing above the free end of the heating tube, whereby in the open position of said closure cap the air distributor member is raised while in the closed position of the closure cap the air distributor member lies on a support ring, over the heating tube.

13. A device according to claim 12 wherein said connecting assembly comprises first and second levers having one end connected to the closure cap and to the air distributor member respectively, and their other end connected to respective ends of a rocking lever which is mounted rotatably at its centre on the heating device.

14. A device according to claim 10 wherein said second pivotal lever of said lever assembly and said fixed member having the aperture for the locking member are disposed on a cover plate which covers a housing accommodating the rotatable closure plate.

15. A device according to claim 1 wherein said mechanical support means is in the form of a stabilising mounting comprising two struts which extend in the longitudinal direction of the device at a spacing from each other and which in their lower region are each fixed to a heat-insulated vessel in which said fuel container is disposed, while in their upper regions the struts support the heating tube in a vertical position.

16. A device according to claim 15 wherein said two struts extend through outwardly bulged vertical side pockets in said receiving vessel and are secured therein.

17. A device according to claim 16 wherein said side pockets are closed at their upper and lower ends by respective flange plates, wherein the struts are extended at least through the upper flange plates of the respective side pockets, and are oil-tight secured, such as by welding, both to the upper and to the lower flange plates.

18. A device according to claim 15 wherein said receiving vessel is provided with three side pockets which are arranged at substantially uniform spacings from each other in the peripheral direction of said vessel, wherein the two struts are mounted and secured in two of said side pockets, and said third side pocket receives a filling connection for filling the fuel container with fuel.

19. A device according to claim 8 wherein the lower ends of said two struts project downwardly from the respective side pockets and form support legs terminating in support plates, and wherein a third support leg which also has a support plate is secured such as by welding to the underside of the third side pocket.

20. A device according to claim 15 wherein said two struts support the heating tube by means of a mounting ring which is fixedly connected to the struts and which embraces the heating tube.

21. A device according to claim 20 wherein said struts extend at an angle of inclination inwardly from the upper end of the side pockets, up to the level of said mounting ring, and from said level extend vertically upwardly parallel to said heating tube.

22. A device according to claim 15 wherein said struts extend upwardly to shortly below the upper end of the heating tube, for example up to the lower end of the last fifth of the height of the heating tube.

23. A device according to claim 20 wherein said mounting ring is of a two-part construction, wherein a first part of the mounting ring is secured to the two struts, and wherein a second part of the mounting ring is connected to the first part releasably, for example by screw means.

24. A device according to claim 15 wherein said stabilising struts are hollow members and in their upper end portions carry correspondingly configured mounting struts which support a horizontal mounting ring for an air distributor member, said ring being disposed at a spacing from the upper edge of the heating tube.

* * * * *